US005097854A

United States Patent [19]

Smith

[11] Patent Number: 5,097,854

[45] Date of Patent: Mar. 24, 1992

[54] HAIR ORNAMENTS INCORPORATING HAIR OF THE WEARER

[76] Inventor: Robert D. Smith, 1305 Sunset Dr., Clearwater, Fla. 34615

[21] Appl. No.: 460,462

[22] Filed: Jan. 3, 1990

[51] Int. Cl.[5] ..... A45D 8/12

[52] U.S. Cl. ..... 132/275; 132/273; 132/278

[58] Field of Search ..... 132/273, 275, 276, 277, 132/278, 279; 446/372, 374, 378, 379, 380, 382, 387, 394; 63/8, 20, DIG. 1

[56] References Cited

U.S. PATENT DOCUMENTS

| | | | |
|---|---|---|---|
| 2,177,426 | 10/1939 | De Journette | 446/387 |
| 2,323,522 | 6/1943 | De Journette | 446/394 |
| 2,552,265 | 5/1951 | Edwards | 63/20 |
| 3,542,041 | 11/1970 | Mercorella | 132/275 |
| 3,789,547 | 2/1974 | Chemarin | 446/369 |
| 3,817,260 | 6/1974 | Kleine | 132/276 |

FOREIGN PATENT DOCUMENTS

| | | | |
|---|---|---|---|
| 2013508 | 8/1979 | United Kingdom | 446/201 |

*Primary Examiner*—John J. Wilson
*Assistant Examiner*—Frank A. LaViola
*Attorney, Agent, or Firm*—Joseph C. Mason, Jr.; Ronald E. Smith

[57] ABSTRACT

Hair ornaments that incorporate the wearer's hair into the ornament. The wearer's hair, in some embodiments, becomes the hair of the ornament in those ornaments of doll-like appearance. In other embodiments, the hair of the wearer serves as the beard of an ornament having a Santa Claus or other bearded character theme. Still further embodiments incorporate the wearer's hair as the grass skirt of a hula doll, as the tail of a pony, as the feathers of a bird, and so on. In all embodiments, the ornament is structured to capture at least one bundle of the wearer's hair so that the hair and the ornament are an integral unit.

13 Claims, 7 Drawing Sheets

Fig. 1
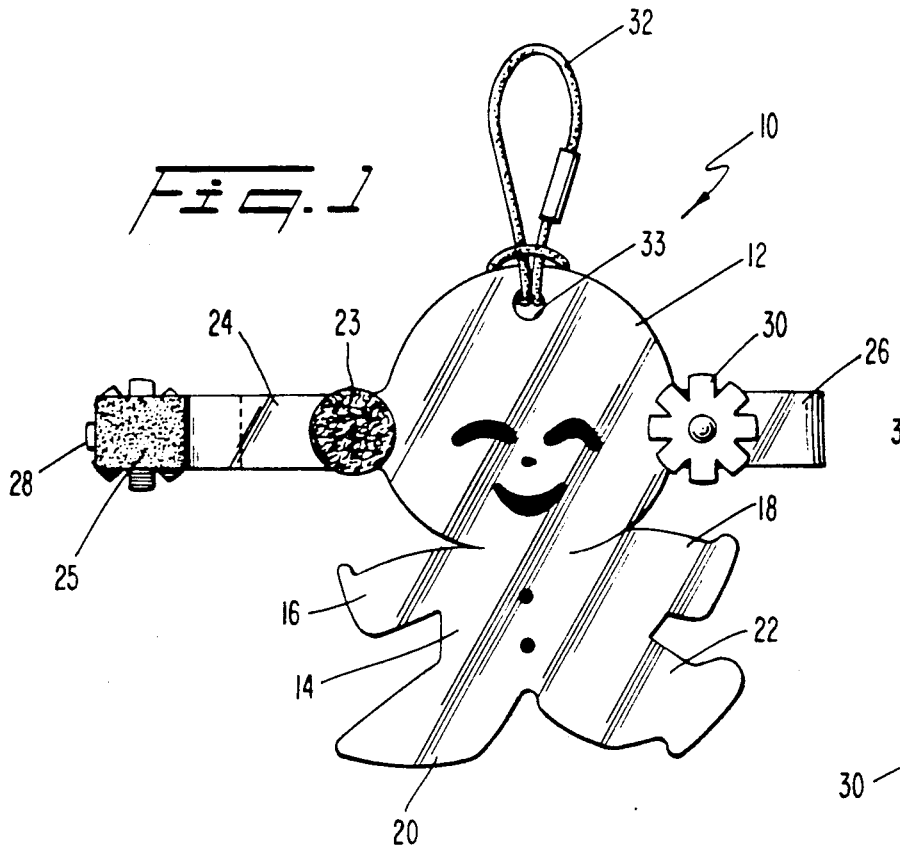
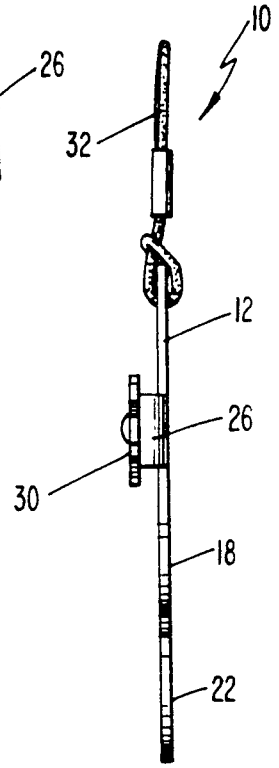
Fig. 3
Fig. 2
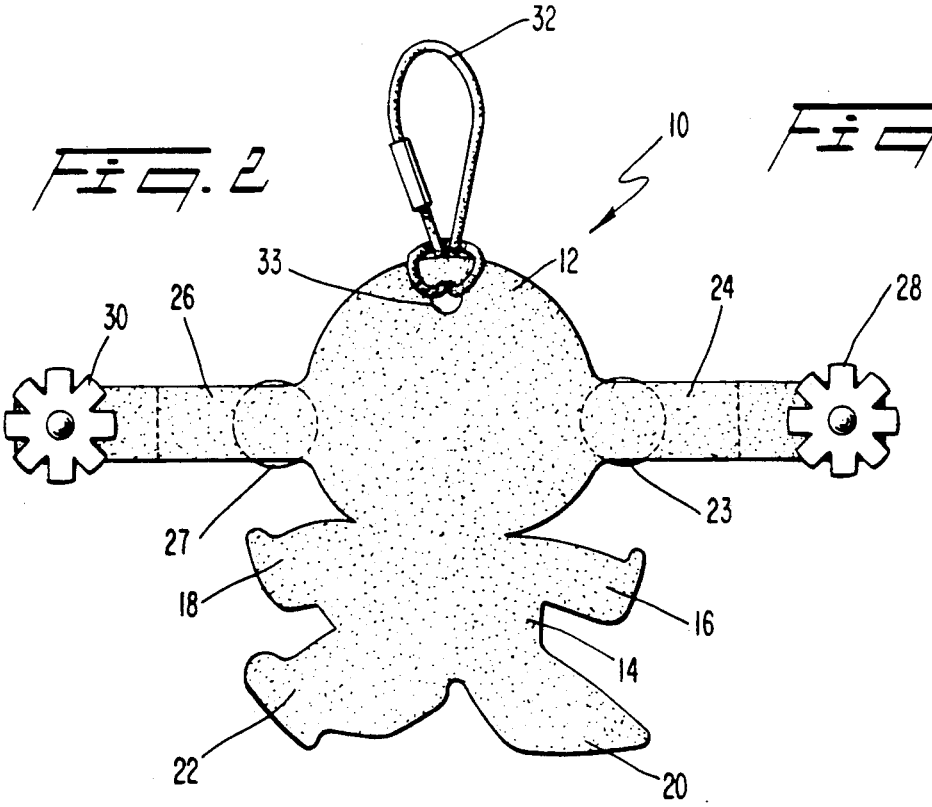

Fig. 4
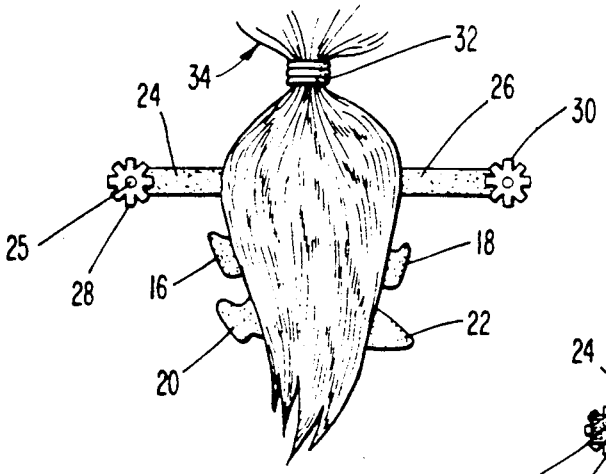
Fig. 5
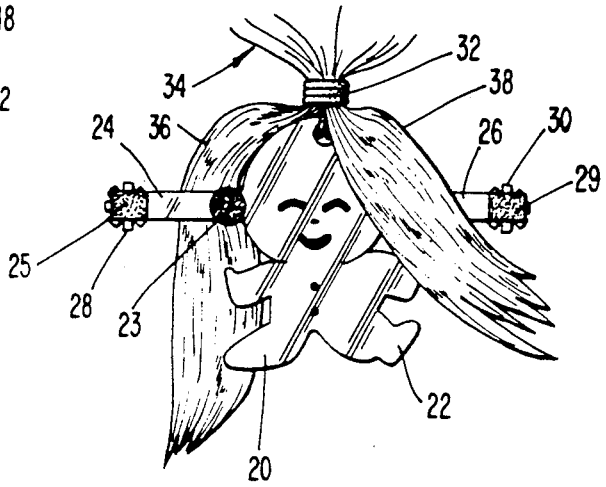
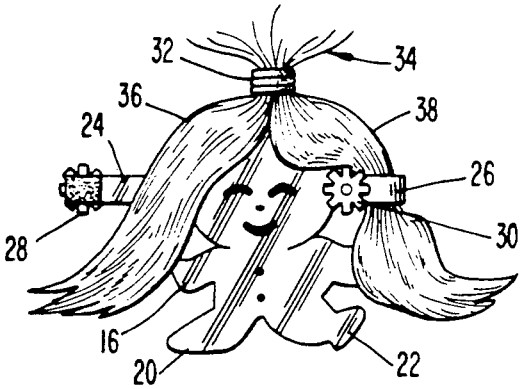
Fig. 6
Fig. 7
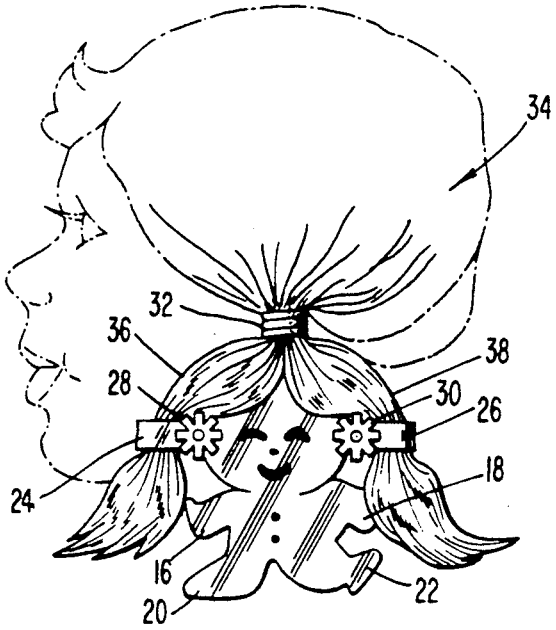

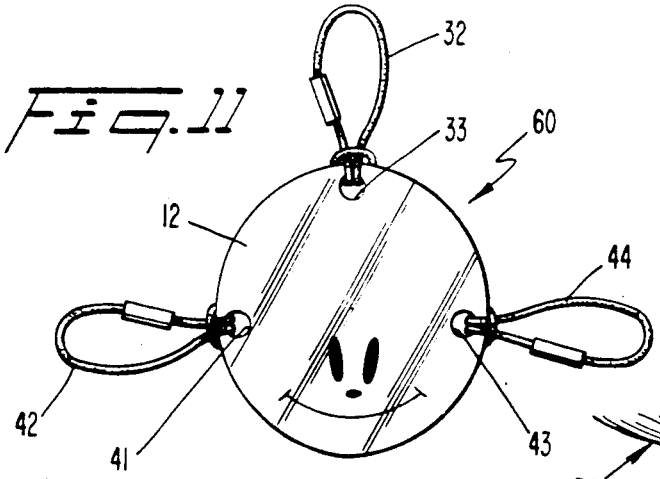
Fig. 11
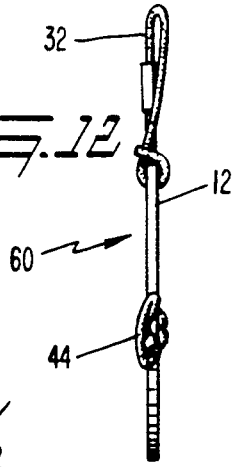
Fig. 12
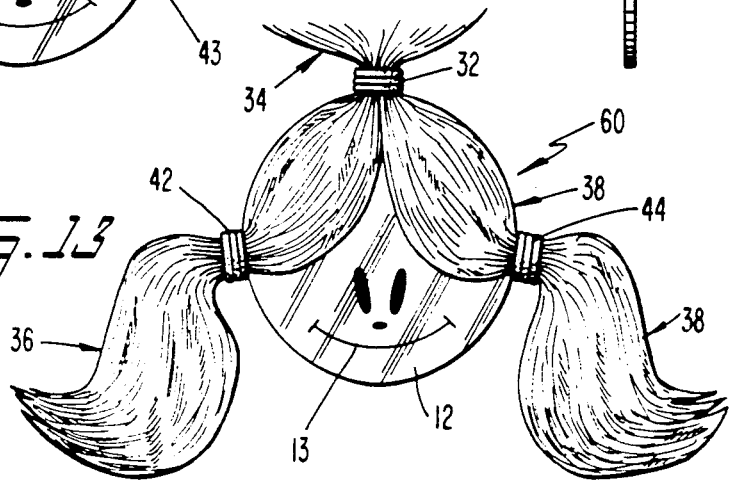
Fig. 13
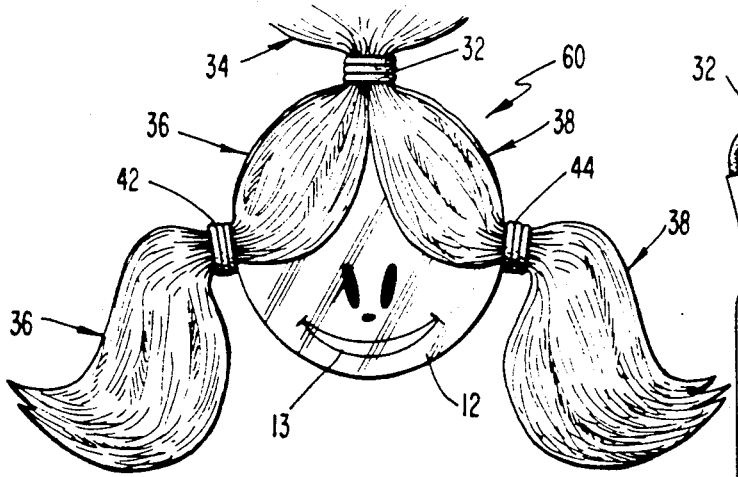
Fig. 14
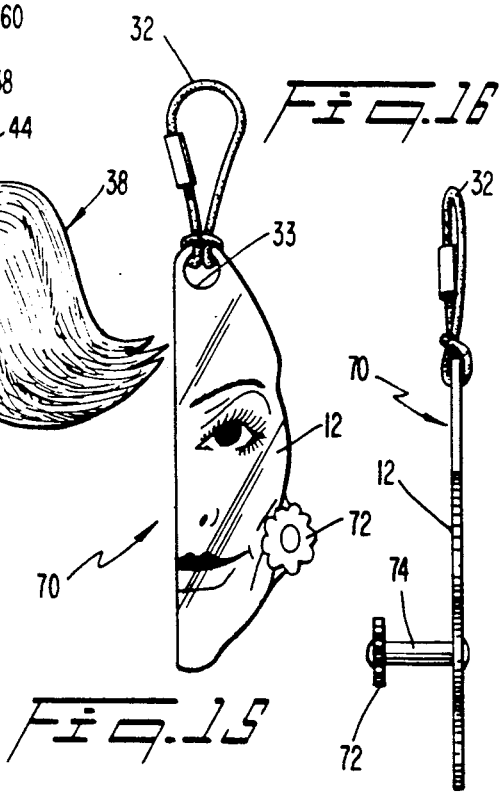
Fig. 16
Fig. 15

Fig. 21
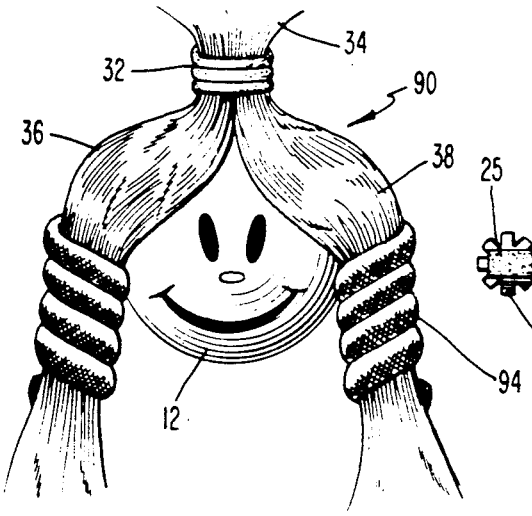
Fig. 22
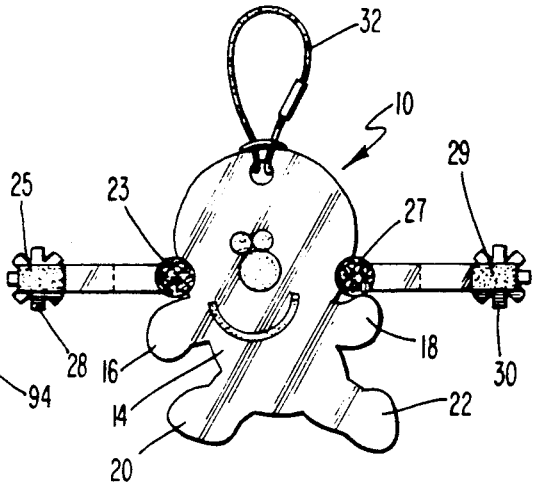
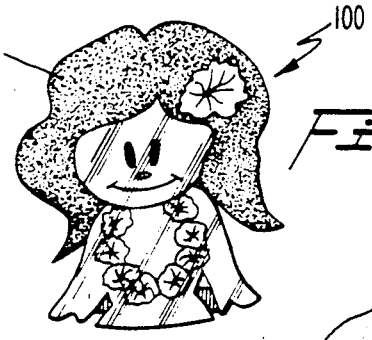
Fig. 24
Fig. 23
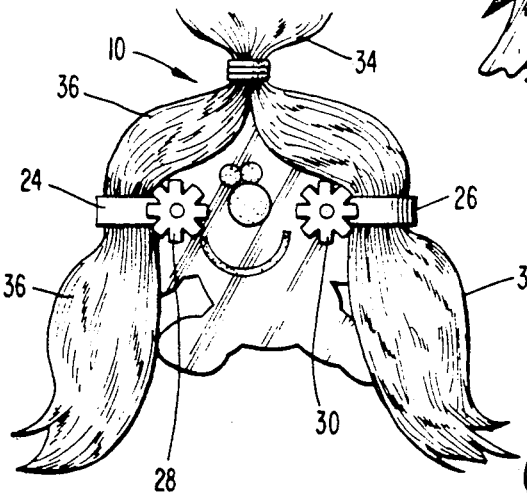
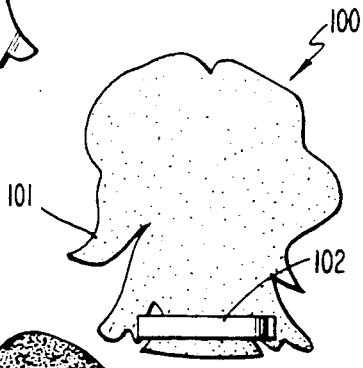
Fig. 25
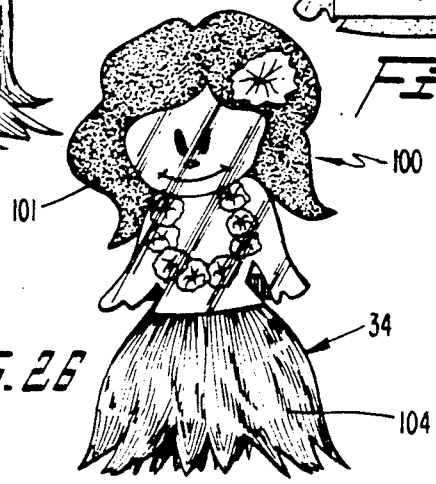
Fig. 26

Fig. 30
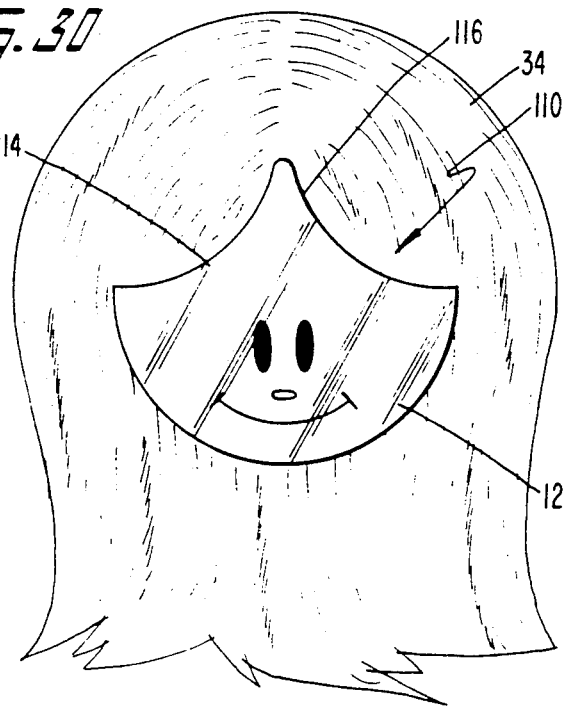
Fig. 27
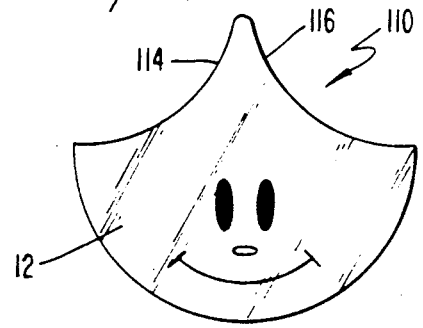
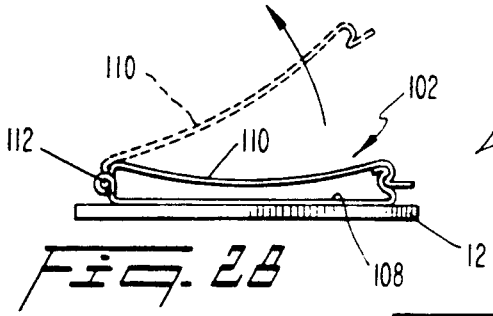
Fig. 28
Fig. 31
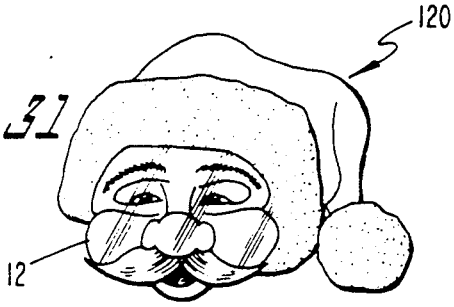
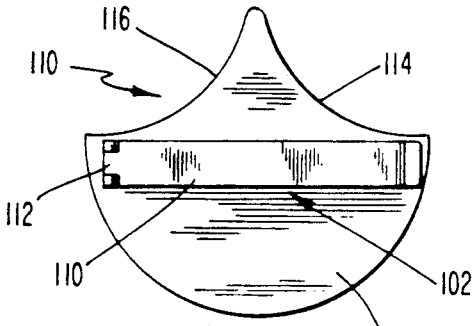
Fig. 29
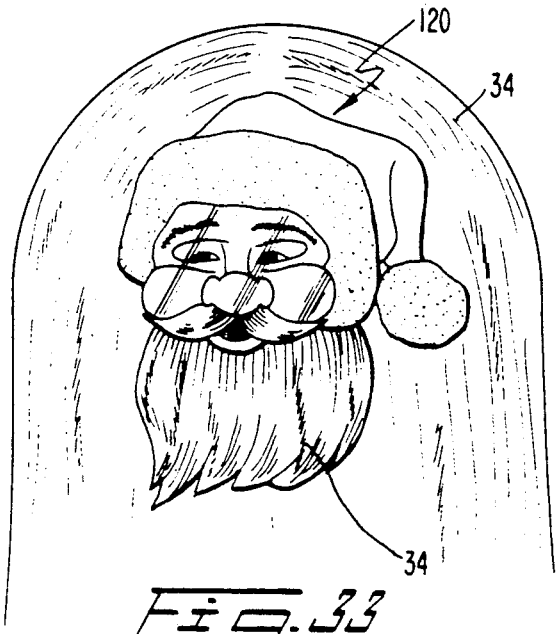
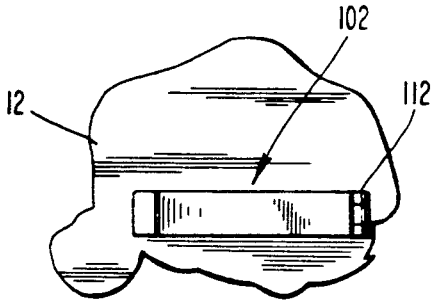
Fig. 32
Fig. 33

HAIR ORNAMENTS INCORPORATING HAIR OF THE WEARER

TECHNICAL FIELD

This invention relates, generally, to hair ornaments. More particularly, it relates to hair ornaments where the hair of the wearer is an integral part of the ornament.

BACKGROUND ART

Hair ornaments have long been in use, especially by people having long hair. Perhaps the most elementary form of hair ornament is the annular band that is used to collect a bundle of hair together to create the appearance of the tail of a pony. Many embellishments of the annular band have been created, but such embellishments are merely decorative items that are added to the band itself.

For example, U.S. Pat. No. 3,099,271 to Dublier shows a connector element for an elastic band for holding a ponytail. As such, it is a representative patent of the large body of art disclosing such elements, including, e.g. Ryder 258,128, Winters, U.S. Pat. No. 2,488,954 and U.S. Pat. No. 2,832,358 to Chambers.

Cox U.S. Pat. No. 4,197,670, on the other hand, is of interest for its disclosure of a doll having arms equipped with Velcro brand adherent G.B. 2,013,508 additionally discloses stick-on face elements.

Schiavo U.S. Pat. No. 4,729,751, Chemarin U.S. Pat. No. 3,789,547, Nachbar U.S. Pat. No. 3,316,669, Piers, Jr. U.S. Pat. No. 3,000,384, Rabinowitz U.S. Pat. No. 2,847,016,Goodman U.S. Pat. No. 3,842,849 and Mercorella U.S. Pat. No. 3,542,041 are likewise of interest for their disclosures of Velcro brand adherent material or the like on doll arms, etc., including material or structure for holding ponytails and the like.

Journette U.S. Pat. No. 2,323,522 shows a flat doll figure having a natural hair holding feature.

Sterling U.S. Pat. No. 1,007,926, Whetzel U.S. Pat. No. 3,889,414 and Noble U.S. Pat. No. 4,715,842 show hairholders or dividers for dolls or human hair.

Rogers U.S. Pat. No. 1,409,411 combines a terminal connector element in the form of a loop for a doll having arm-like members that are adapted to bend into holders for any object. Somewhat similar holders are disclosed in Goldman D192,040, Perkitny U.S. Pat. No. 4,685,893, Cervantes D228,559 and Jackson D180,597. As such, these patents are representative samples of the large body of art disclosing such combinations.

None of the ponytail holders or general hairholders of the prior art are structured so that the hair of the wearer is made an integral part of the ornament.

DISCLOSURE OF INVENTION

The present disclosure pioneers the art of hair ornaments that do more than merely decorate the hair of the wearer. The novel hair ornaments shown and described hereinafter employ the wearer's hair as an integral part of the ornament. The wearer's hair may complete an ornament by providing hair that surmounts an ornament's "head," hair that serves as the "skirt" for a doll ornament, hair that serves as the "beard" of a human face ornament, hair that provides the "tail" of an animal ornament, and the like. The number and type of ornaments made possible by this invention is unlimited, and the claims appended hereto are not limited in coverage merely to the specific examples shown and described herein.

Accordingly, the invention is new, useful and was not obvious to those of ordinary skill in the art at the time it was made in view of the prior art, considered as a whole.

The primary object of this invention is to advance the art of hair ornaments.

A more specific object is to disclose, for the first time anywhere in the world, hair ornaments that incorporate the hair of a wearer as a part thereof.

Other objects and advantages will become clear as this description continues.

The invention accordingly comprises the features of construction, combination of elements and arrangement of parts that will be exemplified in the construction set forth hereinafter and the scope of the invention will be set forth in the claims.

BRIEF DESCRIPTION OF THE DRAWINGS

For a fuller understanding of the nature and objects of the invention, reference should be made to the following detailed description, taken in connection with the accompanying drawings, in which:

FIG. 1 is front elevational view of a first exemplary embodiment of the invention;

FIG. 2 is a rear elevational view thereof;

FIG. 3 is a side elevational view thereof;

FIG. 4 shows the first step in connecting the ornament of FIGS. 1-3 to the hair of the wearer;

FIG. 5 shows the second step thereof;

FIG. 6 shows the third step thereof;

FIG. 7 shows the ornament in an exemplary position on a wearer's hair;

FIG. 11 is a front elevational view of a fourth embodiment;

FIG. 12 is a side elevational view of the embodiment of FIG. 11;

FIG. 13 is a front elevational view of the embodiment of FIG. 11 installed in the hair of a wearer;

FIG. 14 is a view similar to that of FIG. 13, but showing how the ornament is provided with moving lips;

FIG. 15 is a front elevational view of a fifth embodiment;

FIG. 16 is side elevational view of the embodiment of FIG. 15;

FIG. 21 is a front elevational view showing the embodiment of FIG. 20 incorporated into the hair of a wearer;

FIG. 22 is a front elevational view of an eighth embodiment;

FIG. 23 is a front elevational view of the embodiment of FIG. 22 incorporated into the hair of a wearer;

FIG. 24 is a front elevational view of a ninth embodiment;

FIG. 25 is a rear elevational view thereof;

FIG. 26 is a front elevational view showing the embodiment of FIG. 24 incorporated into the hair of a wearer;

FIG. 27 is a front elevational view of a tenth embodiment;

FIG. 28 is a top plan view of the embodiment of FIG. 27;

FIG. 29 is a rear elevational view of the embodiment of FIG. 27;

FIG. 30 is a front elevational view of the embodiment of FIG. 27 incorporated into the hair of a wearer;

FIG. 31 is a front elevational view of an eleventh embodiment;

FIG. 32 is a rear elevational view of the embodiment of FIG. 31; and

FIG. 33 is a front elevational view of the embodiment of FIG. 31 incorporated into the hair of a wearer.

Similar reference numerals refer to similar parts throughout the several views of the drawings.

BEST MODES FOR CARRYING OUT THE INVENTION

Figure 8:
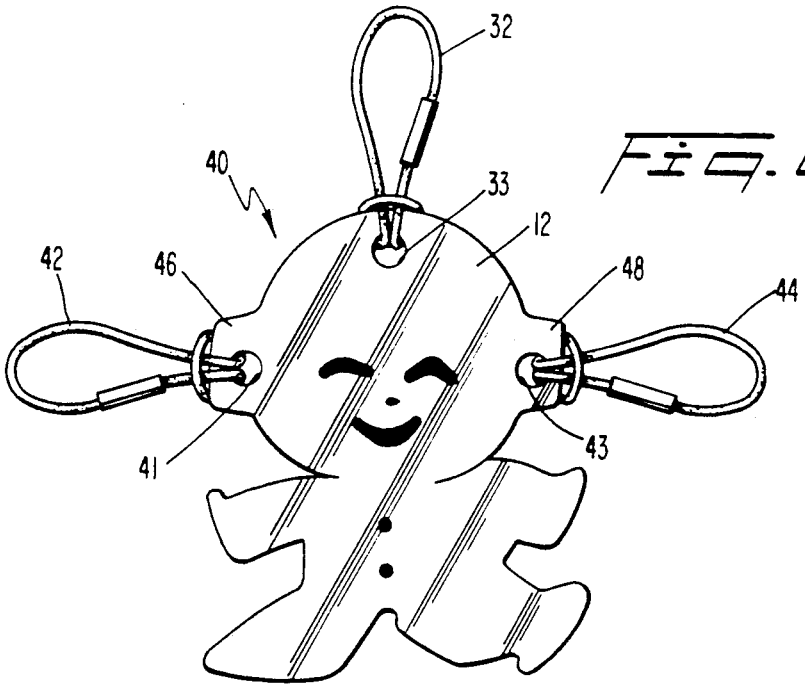
FIG. 8 is a front elevational view of second embodiment of the invention.

A first exemplary embodiment of the invention is denoted as a whole by the reference numeral 10 in FIGS. 1-3. In this example, ornament 10 is the form of a flat doll having a head 12, trunk 14, arms 16, 18 and legs 20, 22.

A pair of flexible, laterally extending, flat hair-holding members 24, 26 are integrally formed with opposite sides of head 12 as shown. A fastening means 23 of the hook and loop type is positioned at the base of hair holder 24 and a complemental fastening means 25 is secured to the distal end thereof. An identical fastening means 27 is secured to the base of hairholder 26 and a fastening means 29 (FIG. 5) complemental to it is secured to the outermost end of holder 26. Fastening means 23, 27 may take the form of buckle bases and means 25, 29 may take the form of buckles that releasably engage said bases; numerous other complementary fastening means may be employed as well.

Decorative members 28, 30 are secured to the respective distal free ends of holders 24, 26, respectively on the respective rearward sides thereof, as perhaps best shown in FIG. 2. These decorative members also serve the utilitarian purpose of facilitating the uncoupling of the hook and loop fastener means from one another, as will become more clear as this description proceeds.

Ornament 10 also includes an elastomeric annular band 32 that is looped as shown through aperture 33 formed in the top of head 12 to enable its attachment to the hair of the wearer. Band 32 is first disposed in snug fitting, circumscribing relation to a preselected bundle of hair 34 as depicted in FIG. 4. Next, as depicted in FIG. 5, the preselected bundle of hair is separated into two substantially equal size bundles 36, 38; bundle 38 is draped over the upper right corner (as viewed) of head 12, over the inner part of holder 26, and holder 26 is folded inwardly over said hair until fastening means 29 releasably engages fastening means 27, thereby creating the configuration shown in FIG. 6. Bundle of hair 36 is then draped over the upper left corner of head 12, as shown in FIG. 6, over the inner part of holder 24 and holder 24 is folded inwardly over said hair until fastening means 25 releasably engages fastening means 23, thereby creating the configuration shown in FIG. 7.

This ornament is the first ornament, anywhere in the world, having the wearer's own hair incorporated into the ornament itself as an integral part thereof. The wearer's hair actually completes the ornament, i.e., the wearer's hair provides the hair of the ornament in a heretofore unknown symbiotic-like relationship.

Instead of selecting a bundle of hair 34 on the side of the individual's head as just depicted, a similar bundle at the back of the wearer's head could just as easily have been selected so that doll 10 would be used as a ponytail ornament.

The variations on this basic invention are numerous, as aforesaid, and in the interest of economy of disclosure, only a few of the variations will be shown and described hereinafter.

In FIG. 8, e.g., the effect of FIG. 7 is achieved by doll 40; a pair of hairholders 42, 44 of the same construction as conventional holder 32, are looped through apertures 41, 43, respectively, which are formed in ears 46, 48 as shown. The left and right bundles of hair 36, 38 (See FIG. 7), are held by hairholders 42, 44 when doll 40 is used, but in all other respects doll 40 is used in the same manner as doll 10.

Figure 9:
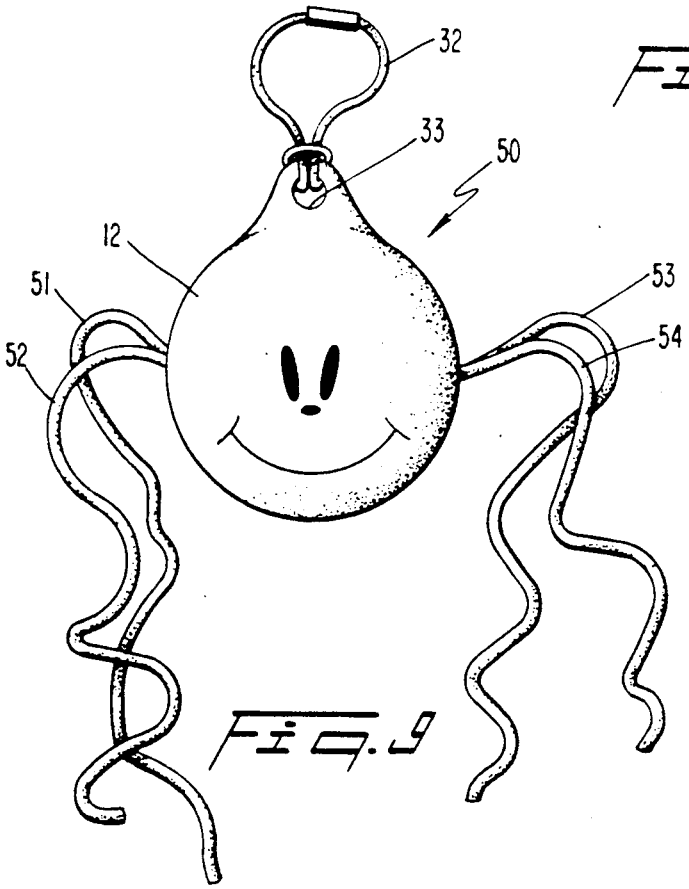
FIG. 9 is a front elevational view of a third embodiment.
Figure 10:
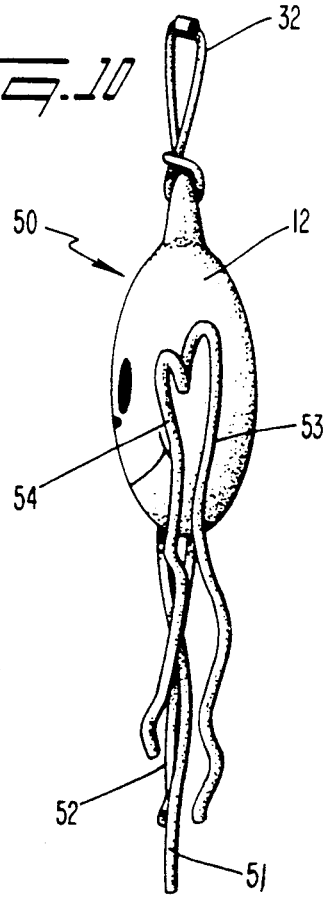
FIG. 10 is a side elevational view of the third embodiment of FIG. 9.

A doll 50 having a non-flat profile is depicted in FIGS. 9 and 10. Doll 50 is also shown without a body although it should be understood that all embodiments shown or mentioned herein may include a head alone or a head with a body.

In this embodiment, the left and right hair bundles 36, 38 are held together by ribbons 51, 52 and 53, 54 respectively, which are suitably secured to opposite sides of the doll's head 12 as shown. To secure each bundle, opposite ends of the ribbons are suitably tied together.

FIGS. 11-14 show a doll 60 having a flat head 12 only and three hairholders 32, 42, and 44 as in the embodiment of FIG. 8. Suitable commercially available means, not shown, are employed to open and close mouth 13 of the doll, as indicated by FIGS. 13 and 14. Moreover, commercially available means, not shown, are employed to provide an audio message that is synchronized with the moving mouth 13 to enhance the illusion that the doll is speaking. The wearer of the ornament would be provided with means for activating and deactivating both the lip movement and the audible sounds.

Figure 17:
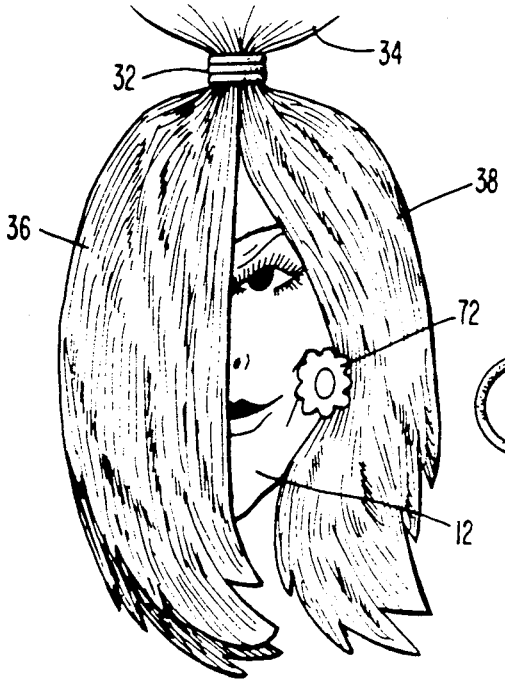
FIG. 17 is a front elevational view of the embodiment of FIG. 16 incorporated into the hair of a wearer.

Doll 70, having half a face 71 only, appears in FIGS. 15-17. This embodiment is unique because it does not employ a holder that wraps around and secures hair bundles 36, 38; instead, as shown in FIG. 17, left bundle 36 is left unbundled and right bundle 38 is not truly bundled but is instead held in the depicted position by a holder 72 that is mounted on a forwardly projecting rod 74 as is perhaps best understood in connection with FIG. 16.

Figure 18:
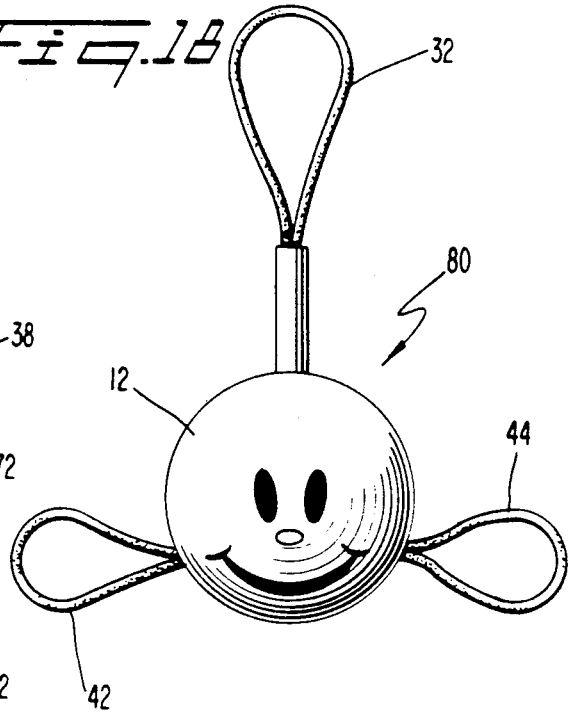
FIG. 18 is front elevational view of a sixth embodiment.
Figure 19:
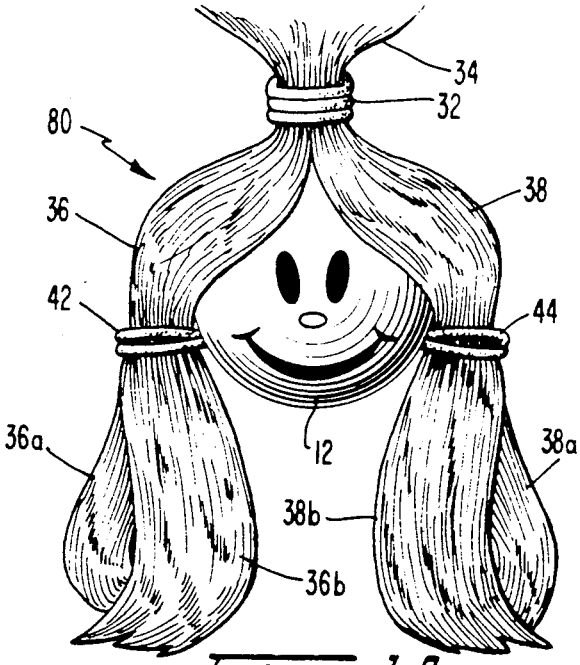
FIG. 19 is a front elevational view of the embodiment of FIG. 18 incorporated into the hair of a wearer.

A ping pong ball or other suitable spherical object 80 is employed in the embodiment of FIGS. 18 and 19; this embodiment is otherwise quite similar to the embodiments of FIGS. 11-14. The spherical head 12 enables a more lifelike representation of a head vis a vis the flat heads of the earlier-mentioned embodiments. Thus, hair bundles 36, 38 are respectively spread further apart at their respected distal free ends as indicated by the reference numerals 36*a*, 36*b* and 38*a*, 38*b* in FIG. 19. Sea shells and other objects can also serve as the head (base member) or other part of the novel ornaments.

Figure 20:
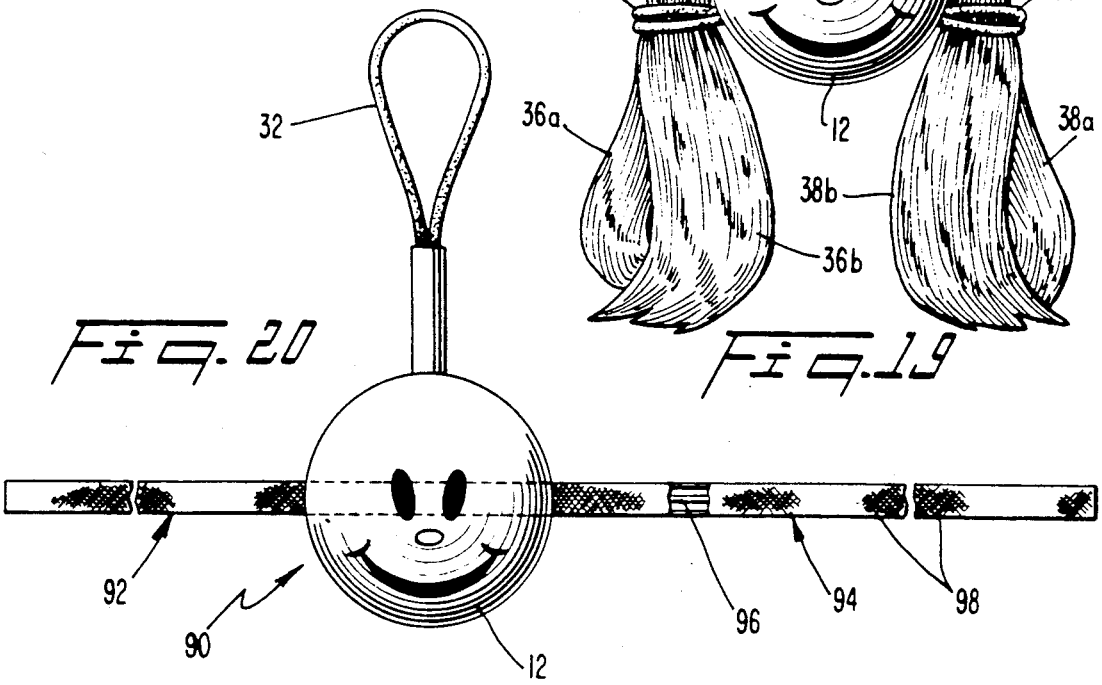
FIG. 20 is a front elevational view of a seventh embodiment.

Doll 90 having laterally extending holders 92, 94 is shown in FIGS. 20, 21; holders 92, 94 include a flexible elongate wire 96 (FIG. 20) covered by a suitable flat paper or plastic cover 98. Accordingly, holders 92, 94 may be helically wound about their associated bundles 36, 38 as depicted in FIG. 21 to present a visually pleasing configuration.

The doll 10 of FIGS. 22 and 23 is identical in all significant respects to doll 10 of FIGS. 1-7, differing only in that it is provided with a zany face to point out that the invention is not limited to the more standard facial constructions of the other embodiments.

FIGS. 24-26 depict doll 100; this ornament shows that this invention is not limited to ornaments where the hair of the wearer is a part of the apparent hair of the ornament as in the earlier-described embodiments. More particularly, doll 100 includes its own apparent hair 101. A hair clip 102 is fixedly secured to the reverse side of ornament 100 as shown in FIG. 25 so that when a bundle of hair 34 of the wearer of ornament 100 is held thereby, the illusion of a hula skirt 104 is thereby created as depicted in FIG. 26.

Another ornament 110 employing clip 102 appears in FIGS. 27-30. There it will be seen that clip 102 includes a metallic base member 108. Closure member 110 is hingedly secured to base member 108 by hinge 112 so that clip 102 can be opened as indicated by the phantom lines in FIG. 28 to facilitate attachment of ornament 110 to the wearer's hair 34 as shown in FIG. 30. Head 12 is cut away as at 114, 116 to save materials while still providing the illusion that doll 110 has bangs similar to the dolls of FIGS. 1-14 and 18-23.

The final illustrative embodiment appears in FIGS. 31-33. Doll 120 is similar to doll 100 of FIGS. 25 and 26, differing primarily because the hair 34 of the wearer becomes a beard rather than a hula skirt.

Having shown a few examples of the wide variety of ornaments made possible by this invention, it is apparent that the variations of the invention are infinite for all practical purposes, and that meaningful patent protection is available only through a broad interpretation of the claims that follow.

For example, ornaments where the tail of a pony or horse is provided by a bundle of hair, where the wings or tail feathers of a bird are provided by the wearer's hair, and so on, are all clearly within the scope of this invention. More importantly, many designs not mentioned herein but which can now be created, for the first time, thanks to this disclosure, come within the scope of this invention if such designs incorporate the hair of the wearer as a decorative part of the ornament.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described:

What is claimed is:

1. A hair ornament, comprising:

a flat base member;

a first hair holding member having a first end secured to a top end of said base member and a second end extending radially therefrom in a first direction;

a second flexible hair holding member of generally flat, linear configuration, having a first end integral to a first side of said base member and having a second end extending radially therefrom in a second, lateral direction;

a third flexible hair holding member of generally flat, linear configuration, having a first end integral to a second side of said base member and having a second end extending radially therefrom in a third, lateral direction opposite to said second direction;

a first releasable fastening means secured to a distal free of said second holding member;

a second releasable fastening means secured to a proximal end of said second holding member, said second fastening means being complemental to said first fastening means;

a third releasable fastening means secured to a distal free end of said third holding member;

a fourth releasable fastening means secured to a proximal end of said third holding member, said fourth fastening means being complemental to said third fastening means;

whereby a first hair-retaining means is defined when said first holding member is wrapped about a preselected bundle of hair;

whereby a second hair-retaining means is defined when said second holding member is folded radially inwardly so that said first fastening means overlies and is releasably secured to said second fastening means;

whereby a third hair-retaining means is defined when said third holding member is folded radially inwardly so that said third fastening means overlies and is releasably secured to said fourth fastening means; and whereby dividing said preselected bundle of hair into two substantially equal first and second subbundles and releasably retaining said first and second subbundles in said second and third holding members provides an ornament that is completed by the hair of an individual wearing said ornament.

2. The ornament of claim 1, wherein said second and third holding members, respectively, have a forward side and a rearward side and wherein said first, second, third and fourth fastening means are respectively fixedly secured to the forward sides of their associated holding members.

3. The ornament of claim 2, further comprising a first decorative member fixedly secured to the rearward of said second holding member, at a distal free end thereof, and further comprising a second decorative member fixedly secured to the rearward side of said third holding member, at a distal free end thereof, so that when said first and second fastening means are releasably engaged to one another and said third and fourth fastening means are releasably engaged to one another, then said first and second decorative members are disposed on the forward side of said base member.

4. The ornament of claim 3, wherein said first holding member is an annular band of elastomeric construction.

5. A hair ornament, comprising:

a base member of predetermined geometrical configuration;

a first hair holding member being fixedly secured to a top end of said base member and extending radially therefrom in a first direction;

a second hair holding member being fixedly secured to a first side of said base member and extending radially therefrom in a second, lateral direction;

a third hair holding member being fixedly secured to a second side of said base member and extending radially therefrom in a third, lateral direction opposite to said second direction;

whereby a first preselected bundle of hair is initially segregated from the hair of the wearer of the ornament and held in a bundle by said first holding member and whereby said first bundle is divided into a second and a third subbundle and held by said second and third holding members respectively, so that the hair of the wearer is an integral part of the ornament.

6. The hair ornament of claim 5, wherein said base member is flat and of generally circular configuration.

7. The hair ornament of claim 5, wherein said base member is of generally spherical configuration.

8. A hair ornament, comprising:

a base member of predetermined configuration;

a first hair holding member being fixedly secured to a top end of said base member and extending therefrom in a first direction;

a second flexible, elongate hair holding member of flat, linear configuration having a first end secured to a first side of said base member and having a second end extending radially therefrom in a second lateral direction;

said second hair holding member including an elongate flexible wire covered along its extent by a flat sheet of preselected material;

a third flexible, elongate hair holding member of flat, linear configuration having a first end secured to a second side of said base member and having a second end extending radially therefrom in a third, lateral direction opposite to said second lateral direction;

said third hair holding member including an elongate flexible wire covered along its extent by a flat sheet of preselected material;

whereby a first preselected bundle of hair is segregated from the hair of the ornament wearer by said first hair holding member and whereby said first bundle is then subdivided into two subbundles which are respectively bundled by said second and third hair holding members wound helically thereabout.

9. A hair ornament, comprising:

a flat base member specifically configured and dimensioned to have the appearance of substantially half of a human face;

a hair holding member being secured to a top end of said base member;

a rod member fixedly secured to said base member and projecting orthogonally therefrom;

a flat, decorative hair retaining member disposed in surmounting relation to said rod member;

said hair retaining member being disposed in parallel relation to said base member;

whereby a first preselected bundle of hair is bundled by said hair holding member and subdivided into two subbundles of hair by draping substantially half of said first bundle over said rod member and by leaving substantially half of said first bundle in an unrestrained configuration so that it appears to substantially overlie an apparent second half of said human face.

10. The ornament of claim 9, further comprising an aperture formed adjacent a top edge of said base member and wherein said hair holding member is an annular band of elastomeric construction that is looped through said aperture.

11. A hair ornament, comprising:

a base member specifically configured and dimensioned have a specific, predetermined appearance;

a hair holding member being fixedly secured to a rearward surface of said base member;

said predetermined appearance including a representation that incorporates the hair of the wearer as an integral part of the representation;

said predetermined appearance relying upon a preselected part of the wearer's hair for its completion;

a hair holding member being fixedly secured to a rearward surface of said base member;

said predetermined appearance being a partial representation of the predetermined appearance;

a preselected bundle of hair held by said hair holding member completing said predetermined appearance; and said predetermined appearance being that of a hula dancer and wherein the preselected part of the wearer's hair provides an apparent hula skirt.

12. The ornament of claim 11, wherein said hair holding member includes a base part that is fixedly secured to said rearward surface of said base member and a closure member hingedly secured to said base part so that said preselected part of the wearer's hair is releasably retained between said base part and said closure member when said closure member releasably engages said base part.

13. A hair ornament, comprising:

a base member specifically configured and dimensioned to have a specific, predetermined appearance;

a hair holding member being fixedly secured to a rearward surface of said base member;

said predetermined appearance including a representation that incorporates the hair of the wearer as an integral part of the representation;

said predetermined appearance relying upon a preselected part of the wearer's hair for its completion;

a hair holding member being fixedly secured to a rearward surface of said base member;

said predetermined appearance being a partial representation of the predetermined appearance;

a preselected bundle of hair held by said hair holding member completing said predetermined appearance; and said predetermined appearance being that of a face and wherein the preselected part of the wearer's hair provides an apparent beard that complements said face.

* * * * *